US010435216B2

(12) United States Patent
Kannengiesser et al.

(10) Patent No.: US 10,435,216 B2
(45) Date of Patent: Oct. 8, 2019

(54) PACK OF PRODUCTS COMPRISING A HANDLE

(71) Applicant: NESTEC S.A., Vevey (CH)

(72) Inventors: Damien Kannengiesser, Golbey (FR); Frederic Drzewiecki, Vittel (FR)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 15/536,810

(22) PCT Filed: Dec. 10, 2015

(86) PCT No.: PCT/EP2015/079325
§ 371 (c)(1),
(2) Date: Jun. 16, 2017

(87) PCT Pub. No.: WO2016/096621
PCT Pub. Date: Jun. 23, 2016

(65) Prior Publication Data

US 2018/0022522 A1 Jan. 25, 2018

(30) Foreign Application Priority Data

Dec. 16, 2014 (EP) ..... 14198353

(51) Int. Cl.
*B65D 71/10* (2006.01)
*B65D 71/06* (2006.01)
*B65D 71/08* (2006.01)

(52) U.S. Cl.
CPC ..... *B65D 71/10* (2013.01); *B65D 71/063* (2013.01); *B65D 71/066* (2013.01); *B65D 71/08* (2013.01)

(58) Field of Classification Search
CPC ..... B65D 71/08; B65D 71/10; B65D 71/063; B65D 71/066
See application file for complete search history.

(56) References Cited

U.S. PATENT DOCUMENTS 3,948,392 A * 4/1976 Faust ..... B65D 71/08 206/432
3,986,611 A * 10/1976 Dreher ..... B65D 71/0096 206/597

(Continued)

FOREIGN PATENT DOCUMENTS

EP 0442111 8/1991
EP 1314647 5/2003

(Continued)

OTHER PUBLICATIONS

European Patent Office Communication for Application No. 15 808 191.9-1017 dated Jun. 27, 2019 (4 pages).

*Primary Examiner* — Steven A. Reynolds
*Assistant Examiner* — Javier A Pagan
(74) *Attorney, Agent, or Firm* — K&L Gates LLP

(57) ABSTRACT

The present invention is directed to a pack of products (1) having a bottom side (2) and an opposite top side (3), comprising a handle (5) formed over the top side (3) and adapted to be grasped by hand. The handle (5) is formed by a plastic film (4) wrapped around the products (1) over at least one turn, the plastic film (4) covering at least most of the bottom side (2) and being gathered to a reduced width over the top side (3) to form the handle (5). A handle (5) formed by a plastic film wrapped around the pack is reliable and easy to manufacture at a limited cost.

17 Claims, 4 Drawing Sheets

(56) References Cited

U.S. PATENT DOCUMENTS

| | | | | |
|---|---|---|---|---|
| 4,304,332 | A | 12/1981 | Danti | |
| 2005/0189388 | A1* | 9/2005 | Godshaw | A45C 3/00 224/607 |
| 2010/0044389 | A1* | 2/2010 | Logue | B65D 21/0219 220/752 |

FOREIGN PATENT DOCUMENTS

| | | |
|---|---|---|
| EP | 1588947 | 10/2005 |
| IT | 1230811 B | 10/1991 |

* cited by examiner

PACK OF PRODUCTS COMPRISING A HANDLE

CROSS REFERENCE TO RELATED APPLICATIONS

The present application is a National Stage of International Application No. PCT/EP2015/079325, filed on Dec. 10, 2015, which claims priority to European Patent Application No. 14198353.6, filed on Dec. 16, 2014, the entire contents of which are being incorporated herein by reference.

FIELD OF THE INVENTION

The present invention relates to the technical field of product packaging, and handling of packaged products.

The present invention concerns a pack of products, in particular retail products, said pack comprising products bound together and a handle adapted to be grasped by hand for carrying the pack.

BACKGROUND OF THE INVENTION

Retail products, for example food products, are commonly packaged in containers such as plastic or cardboard boxes, bottles, pots, or any other kind of packaging. To ease handling of a certain number of products, whether or not they are individually pre-packaged, said products may be held together in a plastic film.

For example, mineral or source water is commonly sold in bottles of various shapes and volumes (for example 1.5 liters), grouped in the form of a pack, e.g. a six pack. The pack of bottles is formed by holding the bottles together in a plastic film. Usually, a heat shrinkable film is used. In this case, the film is positioned around the bottles and then shrunk to bind said bottles in a dedicated oven. According to another process, the bottles may be bound by wrapping in a stretchable plastic film, such as stretch wrap material, making one or several turns around the bottles. Of course, packs may be formed in the same way for almost any product, whether or not individually pre-packaged, such as cereal boxes, beverage cans, tin cans, toilet paper rolls, and so on.

Handling so formed packs is a known difficulty, especially when the packs are large or heavy. To help people, e.g. customers, to carry such a pack, it is known to provide the pack with a handle. The handle is generally made of a plastic or paper strip taped onto the pack. Optionally, foam may be added to the plastic strip for more comfortable handling.

This way of providing a handle has drawbacks. First, when a pack is produced, separate handles have to be provided to be attached to the packs. This implies a supply chain of dedicated logistic means, and/or machines to cut the handles from a strip, add an adhesive layer to the strip and attach the strip to the pack to form a handle. Implementation of these steps in an industrial production process takes time and has a significant cost.

In addition, while such an adhesive handle is generally adequate, it sometimes may break or may tear the plastic film around the pack (i.e. the shrunk thermoplastic film or the wrapped stretchable plastic film). Indeed, adhesion of the handle to the pack is provided over a quite small area or contact surface, having to bear the whole weight of the pack. Thus adhesion of the handle on the film pack is critical due to the small contact surface between the handle and the rest of the pack, and, for the same reason, the strength of the handle and the strength of the plastic film of the pack in the area where they are in contact is critical too.

It is therefore an objective of the present invention to provide a manufacturing process and device for a pack of products optimizing the handling of a pack of products, particularly when the pack is form by wrapping a stretchable plastic film around the products. Said optimization may relate among other to ease of handling, and/or reliability, and/or production cost.

SUMMARY OF THE INVENTION

The objective set out above is met with a pack of products having a bottom side and an opposite top side, comprising a handle formed over the top side and adapted to be grasped by hand. The handle is formed by a plastic film wrapped around the products over at least one turn, the plastic film covering at least most of the bottom side and being gathered to a reduced width over the top side to form the handle.

A handle formed by a plastic film wrapped around the pack is reliable and easy to manufacture at a limited cost. In most cases, using a common commercially available stretch wrap plastic film, no glue or adhesive means may be required to attach the film to the products or packed products. In some embodiments of the invention, no shrinkable film is used to hold the products together, and thus no dedicated oven or heating means is needed: the manufacturing process is thus simpler, cost efficient, and the packed products are not heated during the process.

In an embodiment, at least one turn of the plastic film is wrapped around the products to bind them and at least a subsequent turn of the same plastic film forms the handle.

In the at least one turn forming the handle, the plastic film may be in an ungathered state on the bottom side, and in a state gathered to a reduced width to form the handle over the top side. In particular, the width of the plastic film may be progressively and smoothly reduced from the bottom side to the top side.

In an embodiment, the plastic film ends on the bottom side.

In some cases, two turns of the plastic film form the handle.

The handle may comprise an additional reinforcement strip. The handle may comprise an additional strip made of a soft material, such as foam, to enhance handling comfort.

The plastic film may for example have a thickness comprised between 6 and 40 microns. The plastic film may have a width, when unfolded, of about 500 mm.

In an embodiment, the handle may have a width comprised between 5 mm and 80 mm.

The plastic film may be mainly composed of polyethylene.

In an embodiment, the products are bottles, and preferably bottles of water. The products may also be, for example, one of the following products:

- cereal boxes;
- cartons of beverage or fluid food product;
- cardboard boxes of food product;
- metal cans of food product or beverage;
- plastic boxes of food product;
- toilet paper rolls.

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

Figure 1:
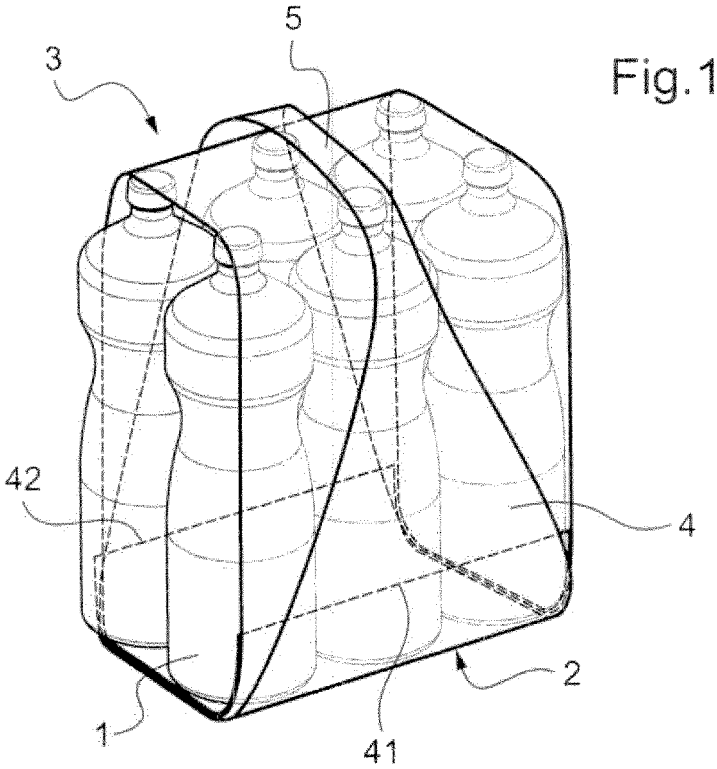
FIG. 1 is a schematic view of a pack of products formed according to an embodiment of the invention.

FIG. 1 illustrates a pack of products according to an embodiment of the invention or obtained by a process according to an embodiment of the invention.

The invention is illustrated in the context of bottle packaging. Bottle packaging is the preferred application of the invention, but many types of products 1 may be packaged according to the invention. The packaged products 1 may for example be pre-packaged products, such as cereals in a carton box, or products that are not pre-packaged such as toilet paper rolls.

The pack of products 1 has a bottom side 2 and an opposite top side 3. The bottom side 2 is generally the side of the pack on which it is supposed to rest, and may be determined for example by the usual orientation of the product (e.g. bottles have a bottom at an opposite end to a neck) or an orientation determined by marking on the products.

In the embodiment represented in FIG. 1, the products are wrapped in a plastic film 4. In particular, the plastic film 4 may be a stretchable plastic film. Such a film may be a commercially available film, e.g. a plastic film commonly used for binding products on a pallet. Such commercially available films are generally made of polyethylene. The most common stretch wrap material is linear low-density polyethylene or LLDPE. Other types of polyethylene and Polyvinyl chloride can also be used. Such plastic films are provided in the form of reels, having a width of 500 mm. Other widths are available, for example 750 mm. The commercially available films have generally a thickness comprised between 6 and 40 microns.

In the represented embodiment, one turn of the plastic film 4 around the products binds them together. In this first turn, the film is wrapped around the products 1 to bind them. In particular, the plastic film may be stretched in its wrapping direction, and, thanks to its elasticity, it imposes forces on the packaged products 1 ensuring cohesion of the pack. Cohesion of the pack may be ensured by many turns of the plastic film 4 around the products. In the represented embodiment, the plastic film is wrapped around the products 1 to bind them over a little more than one turn. Wrapping may advantageously start on the bottom side 2 of the pack, so that the starting edge of the plastic film is not visible when the pack is placed on the ground resting on its bottom side 2.

In the turns ensuring the cohesion of the pack, the plastic film 4 is wrapped in an ungathered state. In said ungathered state, the film 4 has its full width when wrapped, said full width corresponding to the width of the plastic film reel 6 used for enveloping the products. The film 4 has properties of adhesion to itself and possibly on the packaged products. Thus, no glue or other adhesive means is generally needed.

The plastic film turn or turns ensuring the cohesion of the pack form a binding structure around the products. In variant embodiments of the invention, other binding structures may be used for binding the products together. For example, a plastic belt may be tightened around the products. Alternatively, the products may be enveloped into a heat shrinkable film shrunk in an oven or using an adequate heat source.

In a pack according to the invention, at least a turn of a plastic film 4 around the products 1 forms a handle 5 that can be grasped by hand for handling the pack. In the turn or turns forming the handle 5, the plastic film 4 is wrapped in the ungathered state on the bottom side 2, and is in a state gathered to a reduced width to form the handle over the top side 3.

In the represented embodiment of the invention, the same plastic film 4 is used for binding the products 1 and for forming the handle 5. In other words, the plastic film 4 is wrapped around the products 1 to be bound over at least one turn for binding the products together, and then wrapped over one or many subsequent turns to form the handle 5 on the top side 3 of the pack. Typically, the handle 5 may have a width (at least before the pack is carried for the first time by the handle, which may change the initial width of the handle) comprised between 5 mm and 80 mm. The width of the handle 5 is its size in the direction perpendicular to the wrapping direction (and parallel to a wrapping axis). This corresponds to the width of the plastic film when wrapped in the gathered state. To ensure a good distribution of the forces the width of the plastic film is progressively and smoothly reduced from the bottom side 2 of the pack where it is in an ungathered state to the top side 3 of the pack where it is in the gathered state. This smooth reduction of width from the bottom side 2 to the top side 3, or, in other words, the smooth enlargement from the top side to the bottom side, confers on the plastic film a substantially triangular or trapezoidal form on the lateral sides of the pack (i.e. the sides of the pack between the bottom side 2 and top side 3 on which the plastic film is wrapped).

A space may be provided between the top side 3 of the pack and the handle 5 to ease grasping of said handle 5.

The number of turns required to form a reliable handle able to bear the weight of the packaged products 1 depends on said weight of the packaged products 1 and on the mechanical properties of the plastic film used. Typically, when a LLDPE film having a thickness of about 12 microns and a width of 500 mm in the ungathered state is used, two turns are required to form a handle able to bear the weight of a six-pack of 1.5 liters water bottles.

Increasing the number of turns for forming the handle 5 increases its strength, but also increases its width or thickness when compressed, typically when the pack is carried. A sufficient thickness is important regarding the carrying comfort of the pack. To increase the carrying comfort, an additional element (not represented on the illustrated embodiment) may be added under or around the handle 5. For example, a strip of soft material such as foam may be used.

In some embodiments of the invention, the handle 5 may comprise a reinforcement strip (no represented) to increase its strength and which may or may not constitute the above mentioned additional element for comfort.

To hide the edge of the plastic film 4 under the pack, the plastic film 4 advantageously ends on the bottom side 2. Thanks to the properties of adhesion of the film 4 to itself, no additional means are required at the end of the film to fix said end on the pack.

An example of a process for manufacturing a pack of products according to the invention is illustrated in FIGS. 2*a* to 2*g* representing several steps of the process. Parts of a device for manufacturing the pack are also shown in these Figures.

In these FIGS. 2*a* to 2*g*, an orthogonal coordinate (x,y,z) is represented to define three orthogonal directions.

The process starts with providing the products 1 to be packaged. The products 1 may be of many types, pre-packaged or not. For example, the provided products may be cereal boxes, cartons of beverage or fluid food product, cardboard boxes of food product, metal cans of food product or beverage, plastic boxes of food product, toilet paper rolls, or any products to be packed for transport, handling, or sale.

The products 1 are arranged as they will be positioned in the pack once this pack has been formed, and held in position on an adapted support (not shown). The support may for example comprise clamps for holding the products.

In a process according to the invention, a binding structure is fitted around the products and the binding structure is of any type suitable to bind them together. In the represented embodiment of the process, the binding structure comprises one turn of plastic film 4 wrapped around the products 1. The plastic film is provided by a plastic film reel 6. The plastic reel is parallel to the (y) direction defined in the represented (x,y,z) coordinate. An example of a step of fitting the binding structure is illustrated in FIGS. 2*a* to 2*c*.

Figure 2A:
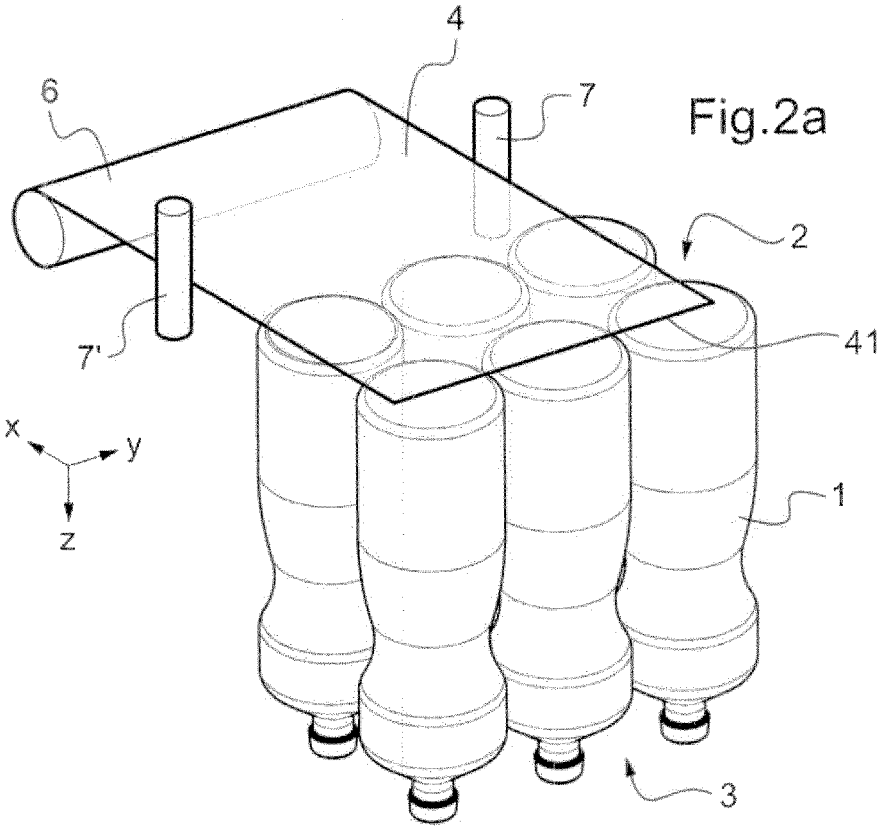
FIGS. 2*a*, 2*b*, 2*c*, 2*d*, 2*e*, 2*f* and 2*g* illustrate successive steps of a process for manufacturing a pack of products according to an embodiment of the invention.
Figure 2B:
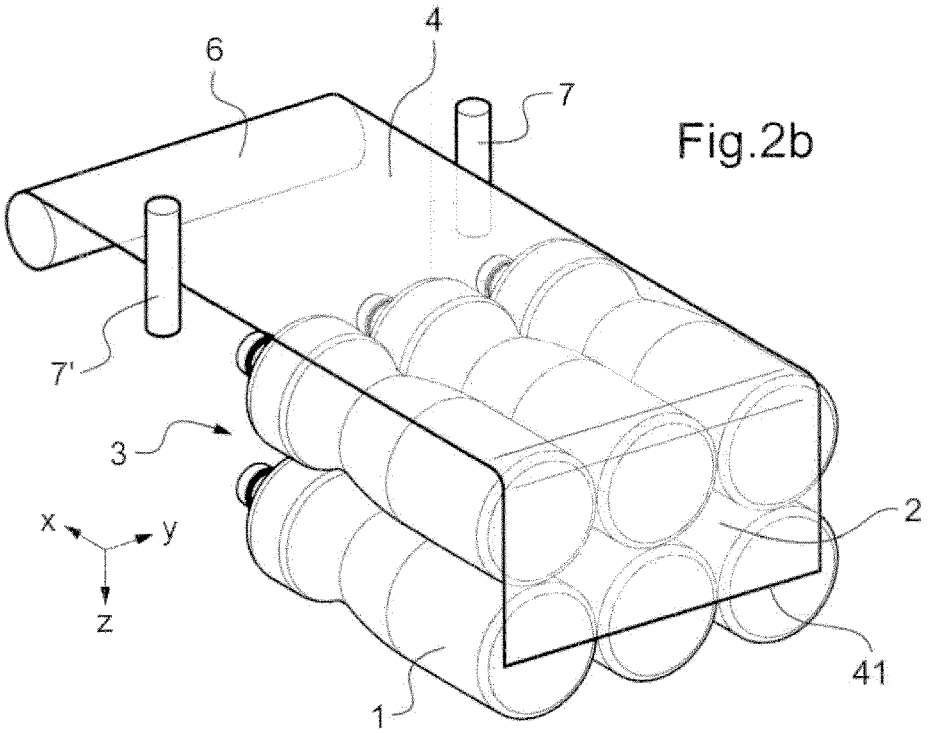
Figure 2C:
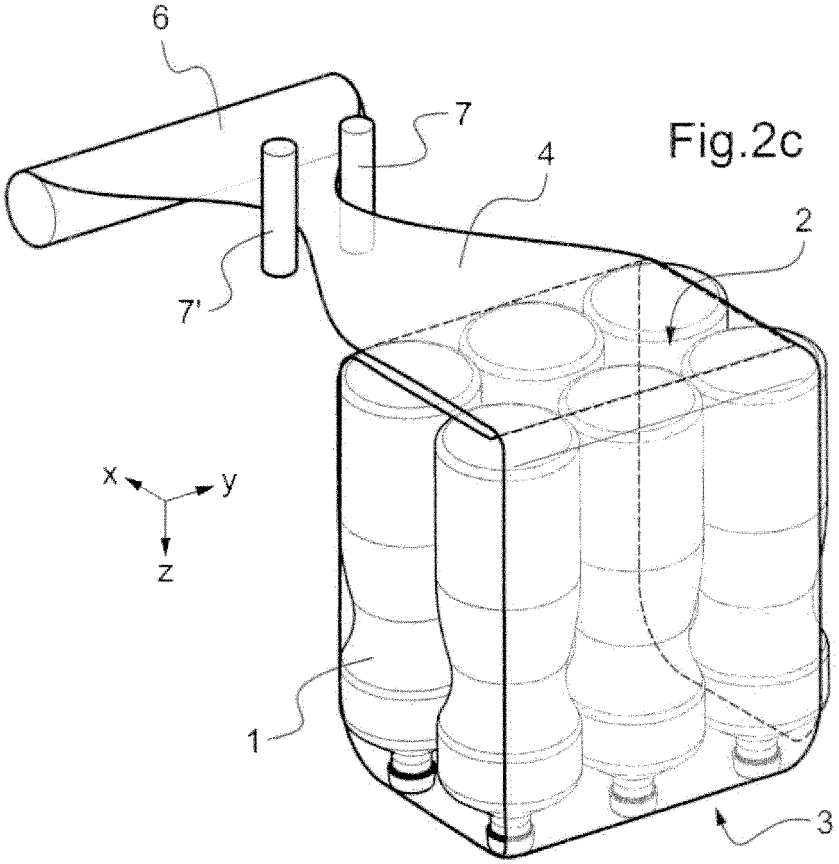

As shown in FIG. 2*a*, a starting edge 41 of the plastic film 4 is placed and maintained on the bottom side 2 of the held products, corresponding to the bottom side 2 of the pack once formed. Starting wrapping of the plastic film from the bottom of the pack makes it possible to hide the starting edge 41 under the pack when it rests on a surface.

To wrap the film around the products 1, a relative movement of rotation of the reel 6 around the products 1 is created. The relative movement of rotation, which may be in practice a movement composed of rotation and translations of the reel around the products 1, comprises mainly a rotation around an axis parallel to the (y) axis. In practice, a mechanism generates this relative rotation through creation of a movement between a reel holder which is configured to hold the plastic film reel 6 and the support adapted to hold the products to be packaged. The mechanism may comprise an assembly for moving the reel holder, the support, or both. Indeed, in most cases (e.g. as long as the product may be moved during the packaging process) it does not matter which one of the reel 6 or the products 1 move to generate the relative movement between them.

In the represented embodiment, the reel holder and thus the reel 6 is fixed (stationary) and the support, and thus the products 1, is mobile, so that the products rotate around an axis parallel to the (y) axis or have a movement composed of rotation and translation in which the rotation axis of the products 1 may move but stays parallel to the (y) axis.

More particularly, the rotation axis of the products may be chosen so that the wrapping is performed in an invariant plane parallel to the (x,y) plane, i.e. the plastic film is unwound in a substantially invariant direction which is, in the represented example, a direction parallel to the (x) axis.

FIG. 2*b* represents an intermediary state of formation of the first turn of plastic film 4 forming a binding structure around the products 1. Compared to FIG. 2*a*, the products have been rotated about one quarter turn (i.e. 90°). At the represented stage, the plastic film is wrapped on a lateral side of the held products 1, corresponding to a lateral side of the future pack. The plastic film 4 is wrapped in an ungathered state to cover most of the surface of the side on which it is wrapped, or, if possible, the whole surface of this side.

In FIG. 2*c*, the products have been rotated a full turn compared to FIG. 2*a*. The plastic film 4 overlaps on the bottom side of the products, where it is thus stuck on itself. At this stage, the products are bound by the first turn of plastic film 4 forming a binding structure.

During the first turn or turns for binding the products 1, the plastic film 4 may be tensioned to be tightly wrapped. The tension imposed on the plastic film 4 may slightly stretch it, so that the film imposes a binding force on the products thanks to its elastic properties. The tension may for example be imposed by braking the reel 6 while the plastic film is unwound by the movement of the products 1 which pulls on the plastic film in the wrapping direction.

The represented device for manufacturing the pack comprises two guides 7, 7' situated between the reel and the support. The plastic film passes between the guides 7, 7' when products are packaged. The guides 7, 7' are configured so that they may impose a reduced width on the plastic film. Width of the plastic film corresponds in the represented example to the size of the film in the (y) direction. The width of the plastic film 4 when wrapped is imposed by the distance between the guides 7,7' at the location where the plastic films passes between the guides, which corresponds to the plane in which the plastic film is unwound from the reel. In particular, when the distance between the guides 7,7' at the location where the plastic film passes between the guides is less than the width or the reel 6, the plastic film is gathered to a width corresponding to said distance between the guides 7, 7'.

At least one of the guides 7, 7' is mobile to change the distance between them, and thus the width of the plastic film 4.

In the represented embodiment, both guides 7,7' are movable in the (y) direction. In this embodiment, the guides 7, 7' have a cylindrical shape. The guides 7, 7' may be moved away from or towards one another, for defining a variable width for the plastic film while it is unwound.

In another variant of the invention (not represented), the guides may have a frusto-conical shape. The distance between the guides is thus variable along the (z) direction. In such a variant, the guide may be moved in the (z) direction, or the reel may be moved in the (z) direction, to change the width of the plastic film while it is unwound.

When the guides 7, 7' have a shape with a generally circular cross-section such as a cylindrical or frusto-conical shape, they may preferably be rotatable around their main axis.

In FIG. 2*c*, the guides 7, 7' have begun to be moved towards one another to gather the plastic film 4. At this stage, the step of forming a handle 5 has begun, the following plastic film turn or turns around the products forming said handle 5.

Figure 2D:
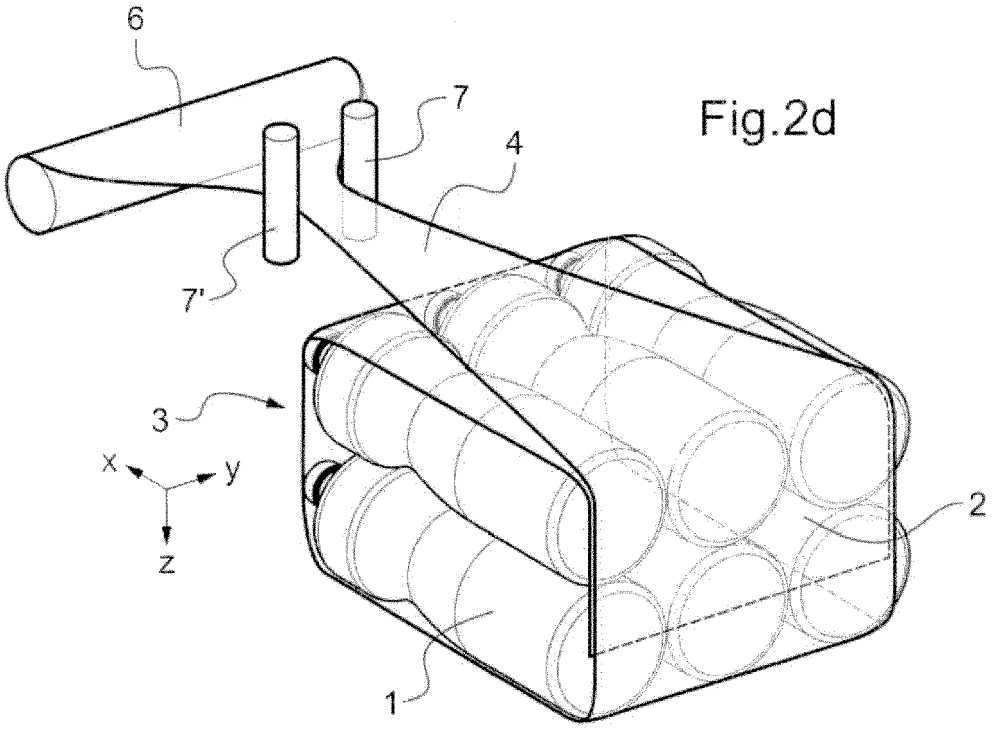

In FIG. 2*d*, the bound products 1 have been rotated about one quarter turn further compared to FIG. 2*c*. The guides are separated by the desired width of the handle 5, the plastic film passing between the guides 7, 7' being gathered to said desired width. In FIG. 2*d*, the plastic film 4 has been wrapped on a lateral side of the pack, from the bottom side 2 to the top side 3. The guides 7, 7' have been progressively brought to the represented close position while the plastic film has been wrapped on the lateral side. The plastic film 4 is thus progressively gathered on said lateral side, from the bottom side 2 to the top side 3 of the pack.

Figure 2E:
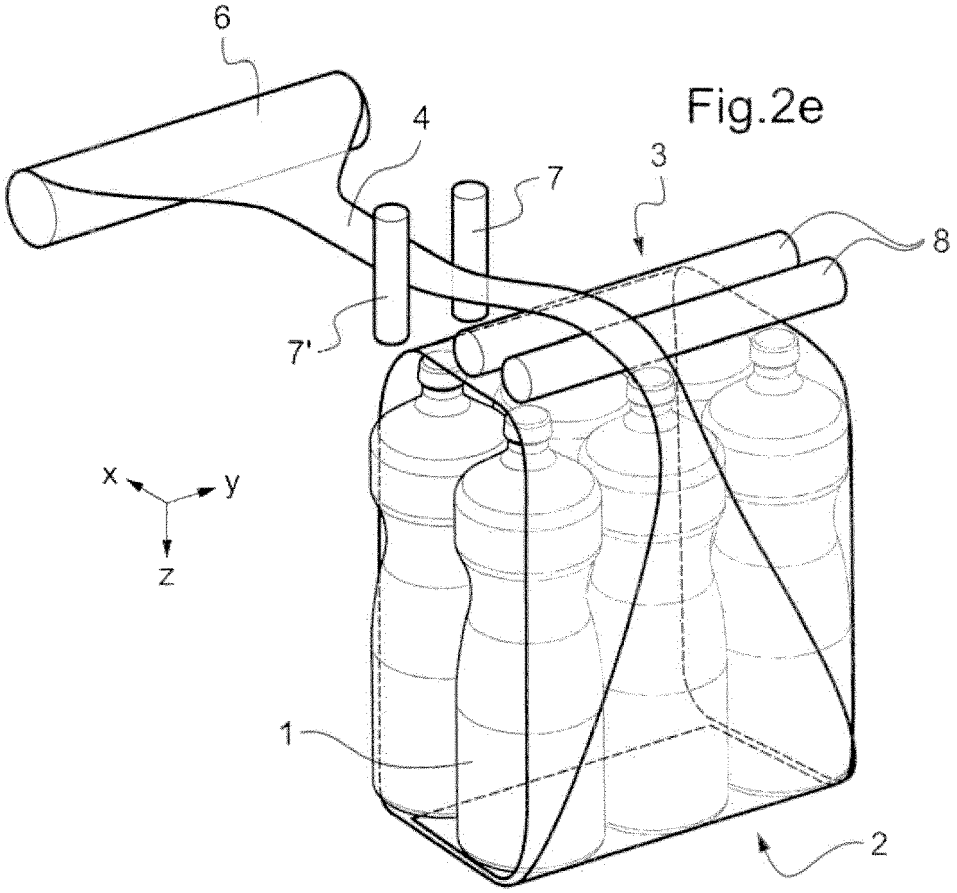

In FIG. 2*e*, the products 1 have been rotated about one quarter turn further compared to FIG. 2*d*. A spacer 8 has been placed over the top side 3 of the products 1. The spacer 8 has been placed shortly after the stage represented in FIG. 2*d*, or, in any case, before the wrapping of the plastic film on the top side 3 has started. For example, the spacer may be placed over the top side 3 as soon as the step of forming the handle 5 starts or will be started (i.e. when the products 1 are bound), e.g. at a stage represented in FIG. 2*c*. In the represented example, the spacer 8 comprises two cylindrical parts arranged in the (y) direction. In other variants of the invention, the spacer 8 may have many other shapes, in particular elongated shapes such as for example a single cylinder, the shape of a half cylinder, or a prismatic shape.

As shown in FIG. 2*e*, in the turn or turns for forming the handle 5, the plastic film 4 is wrapped over the spacer 8. This defines a space between the top side 3 and the formed handle 5. This space is preferably defined to provide easy and convenient grasping by hand of the handle 5.

To be placed over the top side 3 of the products 1 and next removed when the handle 5 has been formed, the spacer 8 may be mobile in a direction parallel to the rotation axis defining the relative rotation of the reel around the support or the products 1, i.e. in the (y) direction. In particular, the device used for forming a handle 5 according to the represented process may be configured to place the spacer 8 at a desired distance from the top side of the products before the handle 5 is formed, and then remove the spacer 8 when the handle has been formed by moving said spacer 8 first towards the top side 3 of the products 1 (in the (z) direction), and next in the (y) direction. The spacer 8 may have a slick surface and/or a convenient external coating to reduce adhesion of the film 4 on it, to ease removal of the spacer when the handle 5 has been formed.

Figure 2F:
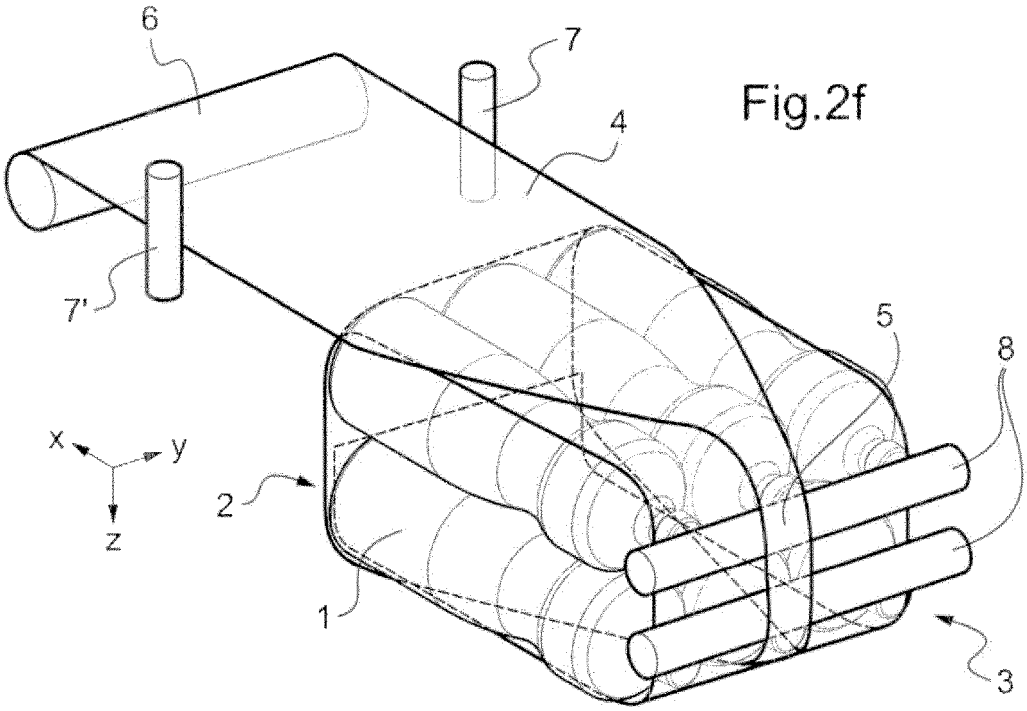

In FIG. 2*f*, the products 1 have been rotated about one quarter turn further compared to FIG. 2*e*. The spacer 8 has been maintained in the same position relative to the top side 3 of the products 1.

In FIG. 2*f*, the plastic film 4 has been wrapped on a lateral side of the pack, from the top side 3 to the bottom side 2. The guides 7,7' have been progressively brought to the represented spaced position while the plastic film has been wrapped on the lateral side. The plastic film 4 is thus progressively ungathered on said lateral side, from the top side 3 to the bottom side 2 of the pack. Thus, the plastic film has the same shape on both lateral sides of the pack in the turn or turns forming the handle 5. This shape is typically a substantially triangular or trapezoidal shape.

The spacer 8 is maintained in position until the end of formation of the handle 5. One, two, three, four turns, or more turns, of plastic film may be required to form the handle 5. The spacer 8 is then removed from the top of the pack as previously explained.

Figure 2G:
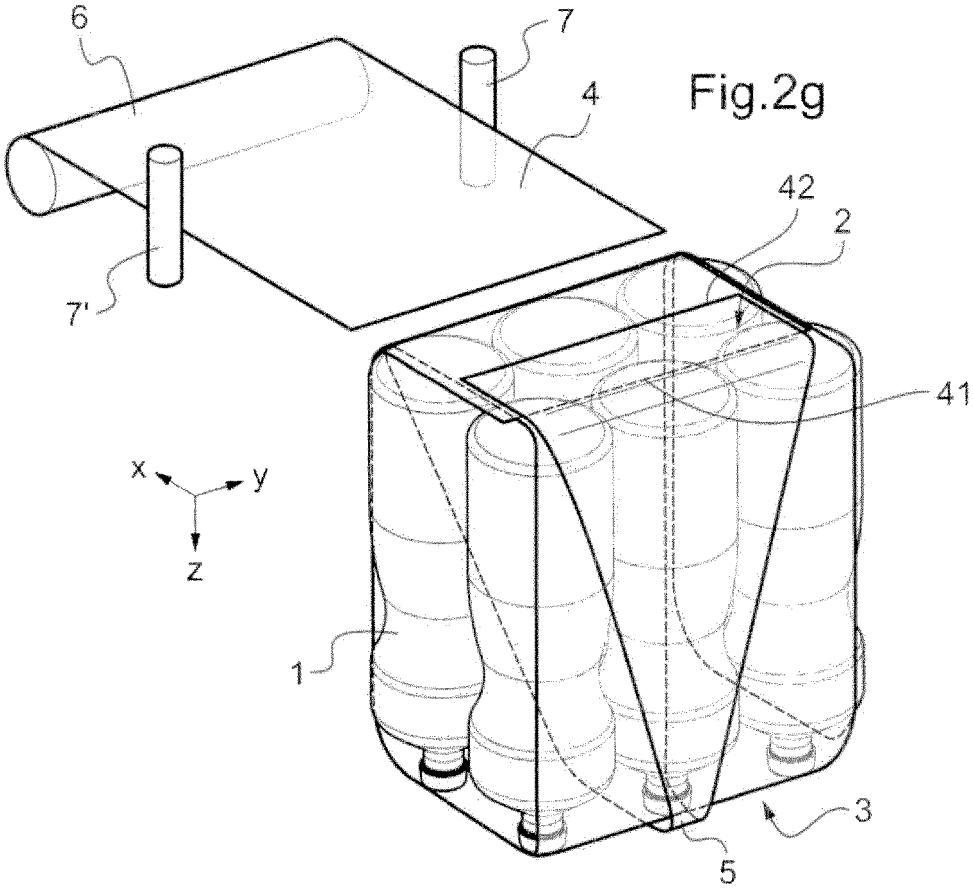

In FIG. 2*g*, the products 1 have been rotated about one quarter turn further compared to FIG. 2*f*. The plastic film is cut and its end edge 42 is pressed against the pack and adheres to itself. The film is preferably, but not necessarily, cut so that it ends on the bottom side 2 to be hidden when the pack rests on said bottom side 2.

In an optional step, an element may be added to the handle 5, such as a reinforcement strip and/or a soft strip made of a soft material to enhance handling comfort. The reinforcement strip may also be made of a soft material enhancing the handling comfort. The added element may be placed on the under surface of the handle or around the handle. Optionally, the added element may be glued to the handle.

In an embodiment, a strip applicator may for example be integrated in the spacer 8. This makes possible to place a strip on the under surface of the handle 5 while the plastic film is wrapped on the spacer 8. In another embodiment, the strip is placed after formation of the handle 5.

The developed invention provides a pack of products, a process and a device for manufacturing such a pack. This pack of products has a reliable handle and may be produced at a low cost, using in most cases commonly available packaging materials. The handle provided in the invention may be adapted to various applications, e.g. by using the appropriate plastic film and number of turns around the products to form it, or by adding or not an appropriate element enhancing strength or comfort. The film used may be transparent, opaque or semi-opaque, decorated for example with a repeating logo or illustration, or not. When the film is transparent, the packed products may be decorated to enhance their attractiveness to consumers. Bottle packaging is one of the preferred applications of the invention, but many other applications are possible, in many domains and especially in the food industry.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A pack of products having a bottom side and an opposite top side, the pack comprising a handle formed over the top side and adapted to be grasped by hand, wherein the handle is formed by a plastic film wrapped around the products, the plastic film covering at least most of the bottom side and being gathered to a reduced width over the top side to form the handle, the handle is formed by at least two turns of the plastic film, the plastic film ends on the bottom side, the plastic film has a length defined by a distance from a first end of the plastic film to a second end of the plastic film, and both the first end and the second end of the plastic film are positioned on the bottom side of the pack of the products.

2. The pack of claim 1, wherein at least one turn of the plastic film is wrapped around the products to bind the products, and at least a subsequent turn of the same plastic film forms the handle.

3. The pack of claim 2, wherein the plastic film is wrapped over one turn to one turn and a half to bind the products, and at least a subsequent turn of the same plastic film forms the handle.

4. The pack of claim 1, wherein in the at least two turns forming the handle, the plastic film is in an ungathered state on the bottom side and in a state gathered to a reduced width to form the handle over the top side.

5. The pack of claim 4, wherein a width of the plastic film is progressively and smoothly reduced from the bottom side to the top side.

6. The pack of claim 1, wherein the handle comprises an additional reinforcement strip.

7. The pack of claim 1, wherein the handle comprises an additional strip made of a soft material to enhance handling comfort.

8. The pack of claim 1, wherein the plastic film has a thickness comprised between 6 and 40 microns.

9. The pack of claim 1, wherein the plastic film has a width, when unfolded, of about 500 mm.

10. The pack of claim 1, wherein the handle has a width comprised between 5 mm and 80 mm.

11. The pack of claim 1, wherein the plastic film comprises polyethylene.

12. The pack of claim 1, wherein the products are bottles.

13. The pack of claim 1, wherein the products are selected from the group consisting of:

cereal boxes;

cartons of beverage or fluid food product;

cardboard boxes of food product;

metal cans of food product or beverage;

plastic boxes of food product; and toilet paper rolls.

14. A process of manufacturing a pack of products having a bottom side and an opposite top side, the process comprising:

wrapping a plastic film around the products at least two turns to cover at least most of the bottom side, the plastic film ending on the bottom side, the plastic film has a length defined by a distance from a first end of the plastic film to a second end of the plastic film, and both the first end and the second end of the plastic film are positioned on the bottom side of the pack of the products;

gathering the plastic film to a reduced width over the top side to forming a handle over the top side to be grasped by hand, the pack of the products is not heated during the process.

15. The process of claim 14 comprising wrapping the plastic film around the products at least one turn to bind the products and at least a subsequent turn to form the handle.

16. The process of claim 15 comprising wrapping the plastic film around the products over one turn to one turn and a half to bind the products and at least a subsequent turn to form the handle.

17. The process of claim 14, wherein the products are selected from the group consisting of cereal boxes;

cartons of beverage or fluid food product;

cardboard boxes of food product;

metal cans of food product or beverage;

plastic boxes of food product; and toilet paper rolls.

* * * * *